US005182604A

United States Patent [19]

Asai

[11] Patent Number: 5,182,604

[45] Date of Patent: Jan. 26, 1993

[54] TRANSFER ROLLER WITH VOLTAGE POLARITY CONTROL

[75] Inventor: Jun Asai, Tokyo, Japan

[73] Assignee: Canon Kabushiki Kaisha, Tokyo, Japan

[21] Appl. No.: 670,172

[22] Filed: Mar. 15, 1991

[30] Foreign Application Priority Data

Mar. 17, 1990 [JP] Japan ..... 2-65563

[51] Int. Cl.[5] ..... G03G 15/16

[52] U.S. Cl. ..... 355/273; 355/219; 355/274

[58] Field of Search ..... 355/273, 277, 271, 272, 355/274, 219, 221; 361/214, 235

[56] References Cited

U.S. PATENT DOCUMENTS

| | | | |
|---|---|---|---|
| 4,166,691 | 9/1979 | Ebi et al. | 355/271 X |
| 4,183,655 | 1/1980 | Umahashi et al. | 355/274 |
| 4,367,032 | 1/1983 | Sakamoto et al. | 355/271 |
| 4,412,732 | 11/1983 | Ogata et al. | 355/315 |
| 4,674,860 | 6/1987 | Tokunaga et al. | 355/274 |
| 4,719,489 | 1/1988 | Ohkubo et al. | 355/290 |
| 4,843,423 | 6/1989 | Nakamura et al. | 355/274 X |
| 5,006,902 | 4/1991 | Araya | 355/271 |
| 5,034,777 | 7/1991 | Ohzeki et al. | 355/274 |

FOREIGN PATENT DOCUMENTS

| | | | |
|---|---|---|---|
| 0323226 | 7/1989 | European Pat. Off. . | |
| 50-153642 | 12/1975 | Japan . | |
| 51-9840 | 1/1976 | Japan . | |
| 61-226773 | 10/1986 | Japan | 355/273 |
| 63-88582 | 4/1988 | Japan | 355/277 |
| 2204508 | 11/1988 | United Kingdom | 355/274 |

*Primary Examiner*—A. T. Grimley
*Assistant Examiner*—Nestor R. Ramirez
*Attorney, Agent, or Firm*—Fitzpatrick, Cella, Harper & Scinto

[57] ABSTRACT

An image forming apparatus includes an image bearing member movable along an endless path, an image forming system for forming a toner image on the image bearing member, and a transfer device for transferring the toner image from the image bearing member to a transfer material at a transfer position. The image forming system includes a charger for charging the image bearing member, and a developer. The transfer device includes a transfer member contactable to a backside of the transfer material. The transfer member is supplied with a voltage having a polarity which is the same as the charging polarity of the toner during a developing operation to transfer the toner from the transfer member to the image bearing member when the transfer material is absent at the transfer position. Also provided is a device for causing a region of the image bearing member to have a potential of the same polarity as the charging polarity of the charger before the region is charged by the charger for image formation.

48 Claims, 8 Drawing Sheets

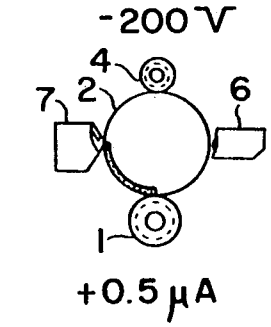
FIG. 13(A)
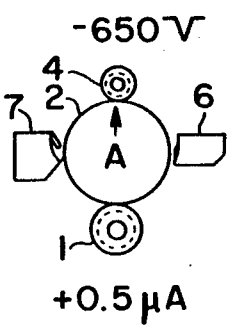
FIG. 13(B)
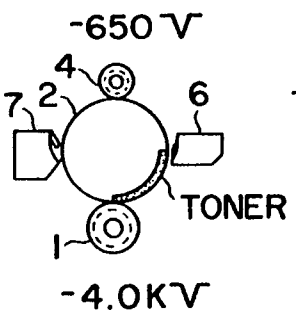
FIG. 13(C)
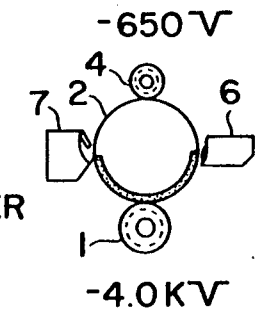
FIG. 13(D)
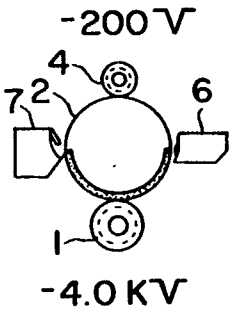
FIG. 13(E)
FIG. 13(F)

TRANSFER ROLLER WITH VOLTAGE POLARITY CONTROL

FIELD OF THE INVENTION AND RELATED ART

The present invention relates to an image forming apparatus such as an electrophotographic machine or an electrostatic recording apparatus, more particularly to an image forming apparatus comprising an image transfer member such as a transfer roller which is contactable to a backside of transfer material to transfer an image from an image bearing member onto the front side of the transfer material.

In a known image forming apparatus, a toner image is formed on a movable image bearing member with electrically charged toner particles; a nip is formed between the image bearing member and a contact type transfer member such as a transfer roller; a transfer material such as paper is passed through the nip; an image transfer bias having a polarity opposite to the polarity of the charge of the toner is applied to the transfer material, so that the resultant electric field functions to transfer the toner image from the image bearing member to the transfer material.

Such a type of image transfer means is advantageous over a well-known corona discharger in that the transfer material can be gripped assuredly so that image deviation does not occur at the transfer station, the transfer bias voltage is relatively low so that the size of the apparatus can be reduced, and the amount of produced ozone is small. Correspondingly, however, such an image transfer means involves a problem arising when the width of an original is larger than that of the transfer material or when a thick original such as a book is printed. In such cases, the area of the image bearing member outside the width of the transfer material is developed, and the toner material outside the width of the transfer material is deposited on the transfer material with the result that the toner scatters to contaminate the parts around the transfer roller or to contaminate the backside of the subsequent transfer material or materials.

As a solution to these problems, Japanese Laid-Open Patent Applications Nos. 153642/1975 and 9840/1976 and European Patent 323226 propose that a cleaning bias voltage having the same polarity as to the toner is applied to the transfer material when the transfer material is absent from the transfer position, so that the toner particles deposited on the transfer material are returned to the image bearing member.

If, however, this is used with an image forming apparatus of a regular development type wherein the charging polarity of the charger for charging the image bearing member for the purpose of image formation is the same as the charging polarity of the transfer charging means for transferring the image from the image bearing member to the transfer material, a problem arises. That is, when the transfer member is cleaned by applying the cleaning bias voltage having a polarity opposite to the charging polarity of the charging means, in other words, the same polarity as the toner, the potential of the image bearing member after it is cleaned, the potential may shift to the opposite polarity, that is, the polarity opposite from the charging polarity of the charging means. If this occurs, the charge remains as a memory which prevents the potential of the image bearing member from rising to the desired level even if the image bearing member is charged by the charging means for the image formation. This results in low image density.

At the transfer position, the potential of the image bearing member has a polarity which is the same as the charging polarity of the charging means after the toner image is transferred onto the transfer material. If the image bearing member has both the potential level of the same polarity as the charging polarity and the potential level of the opposite polarity resulting from the cleaning bias, and if they are in an image area in the next image, the potential difference appears as non-uniformity particularly in a halftone image. The degradation of the image is remarkable when the image bearing member has an organic photoconductive layer on its surface.

In order to reduce the potential difference of the image bearing member before and after the transfer member by changing the level of the cleaning bias applied to the transfer member, the cleaning bias current could be reduced to be lower than the optimum current level. If, however, this is done, toner scattering, and contamination of the backside of the transfer material are not sufficiently prevented.

The above discussed problems are not limited to the case of the use of the transfer member such as a transfer roller, but arise when a member contacting the image bearing member, for example, is supplied with a voltage having a polarity opposite from the charging polarity.

SUMMARY OF THE INVENTION

Accordingly, it is a principal object of the present invention to provide an image forming apparatus in which the contamination of the backside of a transfer material is prevented by cleaning the transfer member.

It is another object of the present invention to provide an image forming apparatus wherein non-uniformity of the image is prevented.

It is a further object of the present invention to provide an image forming apparatus wherein after the image bearing member is charged for the purpose of image formation, the potential of the image bearing member is made uniform in an image region which is going to be subjected to the image formation after the charging.

It is a yet further object of the present invention to provide an image forming apparatus wherein a member contactable to an image bearing member is satisfactorily cleaned.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIGS. 13(A)-(F) are schematic views of the cylindrical image bearing member, the charging roller and transfer roller when the photosensitive member is in different positions.

DETAILED DESCRIPTION OF THE PREFERRED EMBODIMENTS

Figure 1:
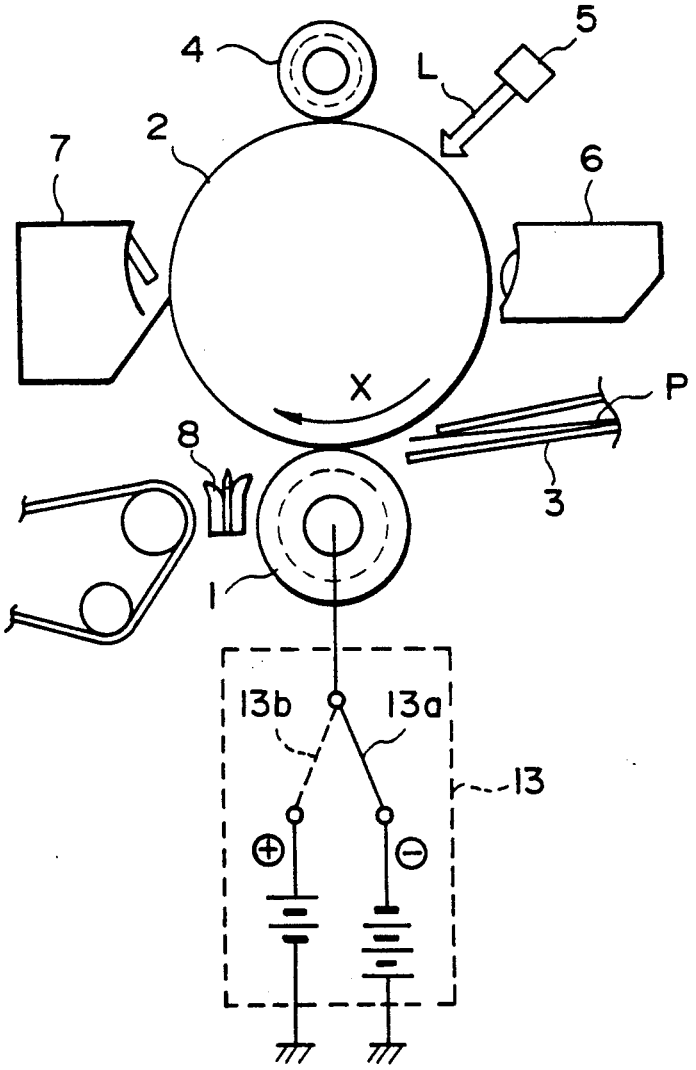
FIG. 1 is a side view of a major part of an image forming apparatus to which the present invention is applicable.

Referring to FIG. 1, there is shown an exemplary image forming apparatus to which the present invention is applicable. It comprises a cylindrical image bearing member in the form of a photosensitive member 2 which has a negative charging property and which is rotatable in a direction indicated by an arrow X in an endless path about an axis perpendicular to the sheet of the drawing. The surface thereof is uniformly charged to a negative polarity by a charging roller 4 which is a charging means. The charged surface is exposed to image light by an exposure means 5 in accordance with image information, so that an electrostatic latent image is formed. A developing device 6 supplies charged toner particles to a electrostatic latent image, so that the toner image is provided. The toner particles have been charged to the positive polarity, that is, the polarity opposite from the charging property of the charging means, and therefore, the development is a regular development. The developed image is carried on the image bearing member to a transfer station wherein a nip is formed by press-contact between the image bearing member 2 and the transfer member in the form of a transfer roller 1.

On the other hand, a transfer material P is supplied to the transfer station along a transfer sheet guide 3. The backside of the transfer roller is press-contacted to the transfer roller 1, and the transfer roller 1 is supplied with a transfer bias voltage of the polarity opposite to that of the toner during the developing operation, from a voltage source 13. The electric field provided by the transfer bias voltage application is effective to transfer the toner image from the image bearing member to the transfer material P. At this time, a switch of the voltage source 13 takes a solid line position 13*a*.

Subsequently, the transfer material P is electrically discharged by means of discharging needles 8 and is conveyed to an unshown image fixing station along a guiding passage.

Residual toner particles not transferred onto the transfer material P are removed from the image bearing member by a cleaner 7, so that the photosensitive member 2 is prepared for the next image forming operation.

When the transfer roller 1 which is a member contacting to the image bearing member 2 is supplied with an image transfer bias voltage having a polarity which is the opposite from the charge of the toner during the developing operation, the toner is deposited on the transfer roller 1 if the toner deposited region of the photosensitive member 2 is larger than the size of the transfer material P. In view of this, at least during a part of time in which the transfer material P is absent at the transfer station, such as a post rotation duration which is prior to the execution of the image forming operation of the photosensitive member 2 or the duration after passage of a transfer material P and before the next transfer material P reaches the transfer position when plural image forming operations are continuously carried out, the transfer roller 1 is supplied with a cleaning bias voltage having the same polarity as the toner during the developing operation, that is, a polarity opposite from the polarity during the transfer operation, from a voltage source 13. It is preferable that the cleaning bias voltage is applied to the transfer roller 1 during the period corresponding to at least one full-rotation of the transfer roller 1. By doing so, the toner on the transfer roller 1 is returned to the photosensitive member, so that the contamination of the transfer material and the scattering of the toner inside the apparatus can be prevented. During the cleaning bias application, the switch of the voltage source 13 takes the broken line position 13*b*.

In the shown apparatus, the photosensitive member 2 is an OPC photosensitive member having a negative charging property. It has a diameter of 60 mm and is rotated at a process speed of 70 mm/sec. The transfer roller 1 has a diameter of 20 mm and a length of 230 mm. It comprises a core metal coated with foamed EPDM (tercopolymer of ethylenepropylenediene) layer in which carbon is dispersed. The volume resistivity thereof when 1 KV is applied to the transfer roller is $10^9$ ohm.cm. The transfer roller 1 is subjected to a constant voltage control with −4.0 KV during the transfer operation, and is subjected to a constant current control with +0.5 micro-ampere during the cleaning operation.

The charging roller 4 has a diameter of 12 mm and has a core metal coated with EPDM layer in which carbon is dispersed. The volume resistivity thereof is $5\times10^8$ ohm.cm when it is supplied with a 1 KV voltage.

Figure 9:
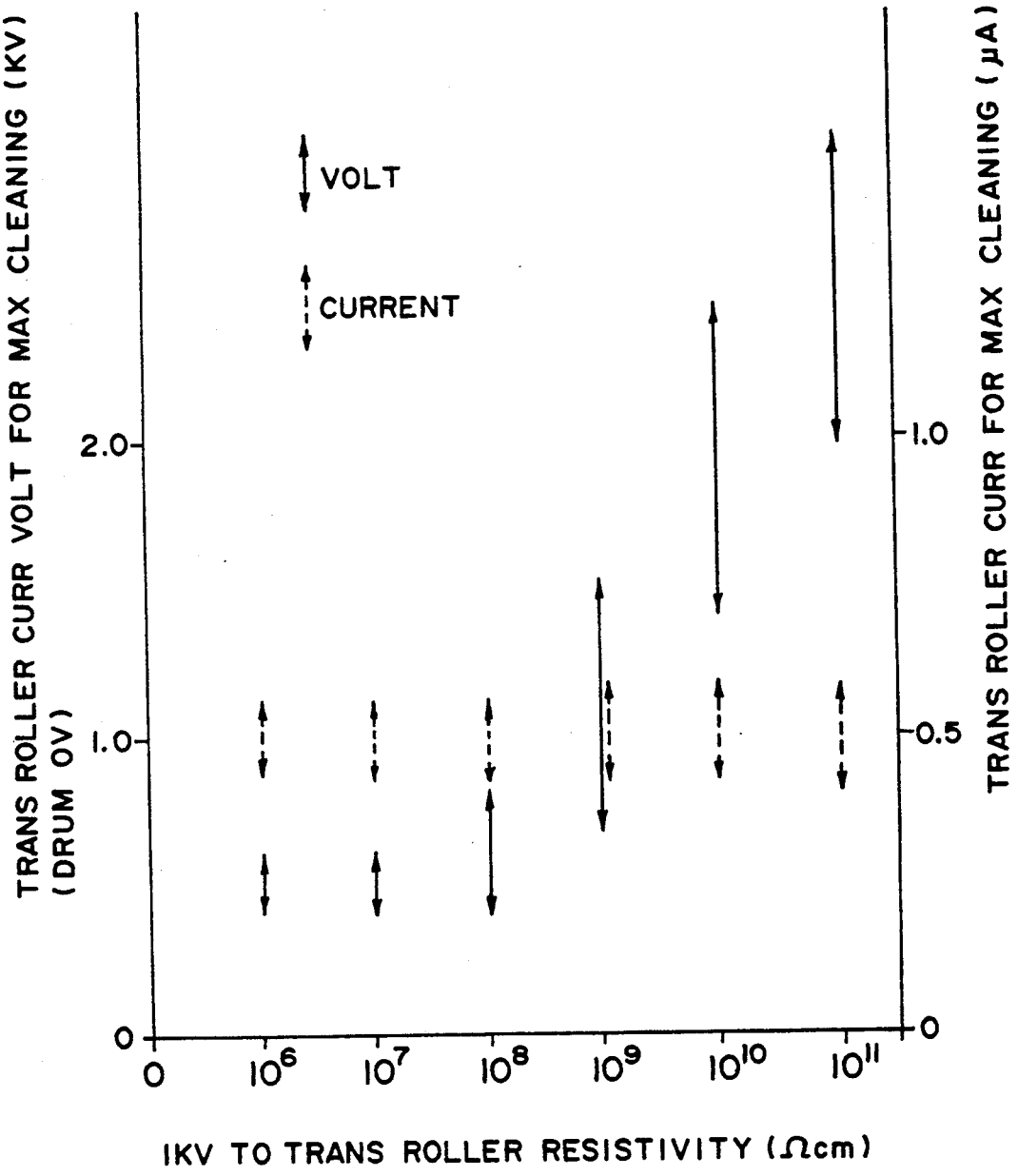
FIG. 9 is a graph showing relations among resistivity of the transfer roller and voltage and current providing good cleaning operation.

FIG. 9 shows the relation between the volume resistivity of the transfer roller and the voltage and current of the transfer roller 1. The graph shows the voltage and current range providing highest cleaning efficiency in relation with the changeable volume resistivity of the transfer roller. As regards the voltage, when the volume resistivity is low, the maximum effect is provided at approximately +500 V. However, if the volume resistivity is not less than $10^{10}$ ohm.cm, approximately +1.4 KV or higher voltage is required.

As regards the current, the cleaning effect is a maximum at approximately +0.5 micro-ampere for almost all of the resistivities.

This is converted to a charge density of approximately $3\times10^{-9}$ C/cm$^2$. This is substantially the same as the charge density of the toner when the dark potential region of the photosensitive member 2 is developed after it is charged by the charging roller 4 and without exposure to light.

When the toner is transferred onto the transfer roller from the above-described dark potential region of the photosensitive member, it is considered that the application of the electric charge to the transfer roller capable of dissipating the electric charge enhances the cleaning effect (returning the toner from the transfer roller to the photosensitive member), and that if the charge becomes excessive, the toner on the transfer roller is charged to a polarity opposite from the charging polarity during the developing operation, so that the cleaning efficiency is lowered.

Figure 10:
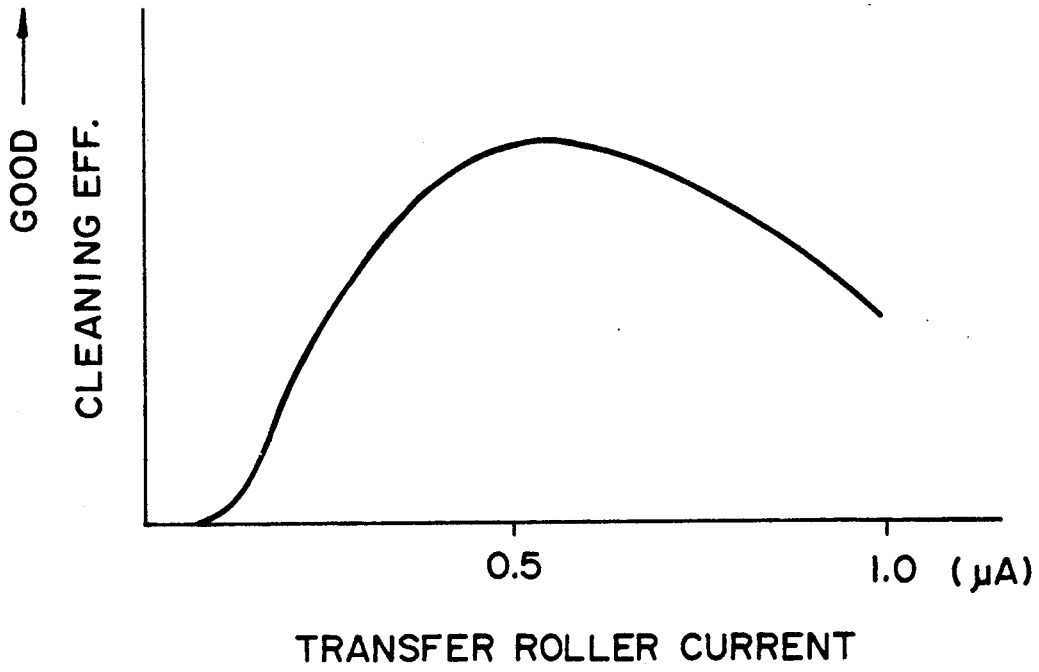
FIG. 10 is a graph showing a relation between a transfer current and the cleaning effect.

FIG. 10 shows the relation between an actual current supplied to the transfer roller and the cleaning effect for the transfer roller. As will be understood, the cleaning efficiency is maximum when the current is +0.5 micro-ampere.

Figure 11:
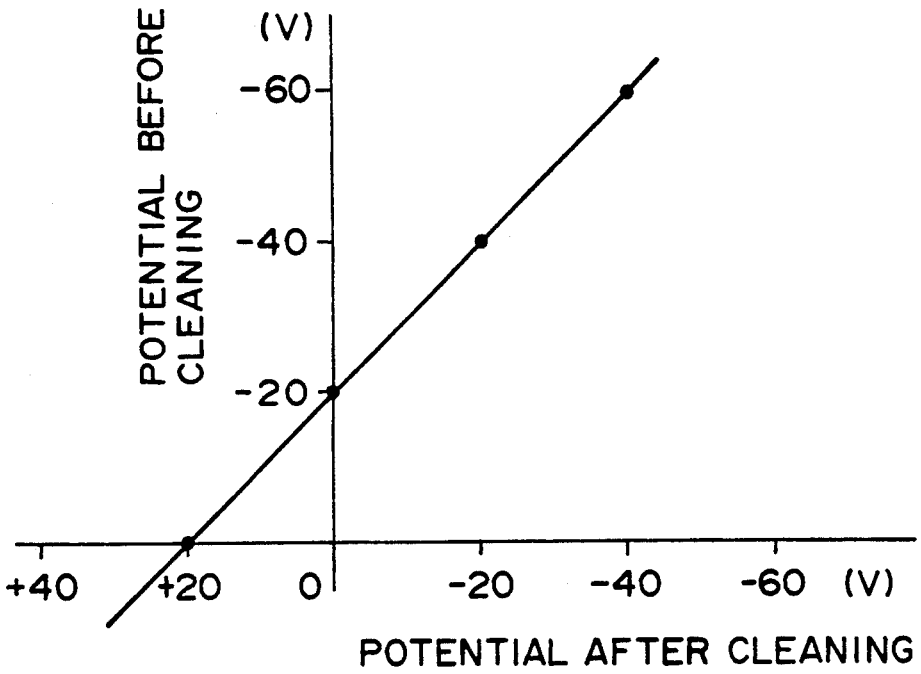
FIGS. 11 and 12 are graphs of surface potential of an image bearing member before and after it is subjected to the image transfer charging.

FIG. 11 shows a relation between the potential of the photosensitive member after the cleaning (downstream of the transfer position) and the potential of the photosensitive member before the cleaning (upstream side of the transfer position), when the current supplied to the transfer roller is +0.5 micro-ampere.

As will be understood from the foregoing, if the optimum cleaning current is selected, the polarity of the photosensitive member potential after the cleaning is shifted from that before the cleaning to the polarity of the voltage applied to the transfer roller.

Where the image forming apparatus uses a regular developing system as in an analog copying machine, the polarity of the toner during the developing operation is opposite from the charging property of the photosensitive member, that is the charging polarity of the charging means for charging the photosensitive member for the purpose of image formation thereon. Therefore, the polarity of the cleaning bias voltage applied to the transfer roller 1 is also opposite from the charging polarity.

If the polarity of the surface potentials of the photosensitive member are different before the charging, in the area which is going to be next image area, the surface potential of the photosensitive member becomes non-uniform after the charging, although it depends on the charging power of the charging means. If this occurs, the resultant image has a non-uniform image density, particularly in a halftone image.

Figure 12:
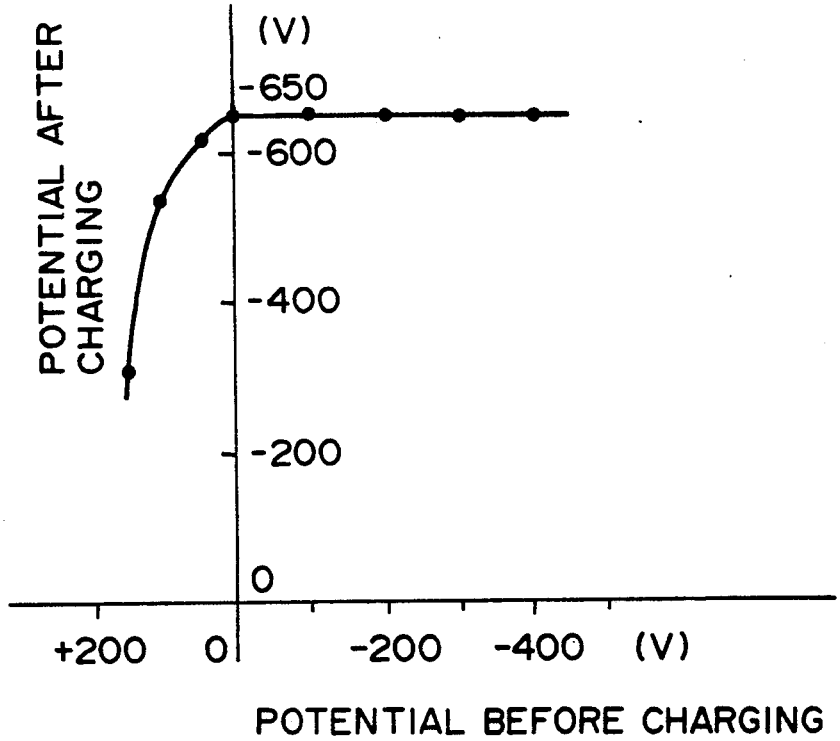

FIG. 12 shows the dependence of the potential after the charging on the potential before the charging when the OPC photosensitive member having the negative charging property is charged by a charging roller 4 (charging means). As will be understood, unless the photosensitive member potential before the charging in the image area is on the negative polarity side (charging polarity), the potential of the photosensitive member decreases beyond the desired level of +650 V, with the result of a density non-uniformity. The charging roller 4 is supplied with a voltage having a peak-to-peak voltage Vpp of 1500 V biased with a DC component of −650 V, in the form of a sine wave.

In order to prevent the density non-uniformity, the cleaning bias (positive) supplied to the transfer roller 1 from the voltage source 13 is switched to the transfer bias side (negative), and thereafter, the image forming operation is controlled such that the part of the photosensitive member 2 surface having passed through the transfer position which is supplied with the transfer bias is in the next image forming region. In other words, the negatively charged part of the photosensitive member 2 by the transfer roller 1 is used as the image area during the next image forming operation.

However if this, sequence of the operation is used, the cleaning bias application period becomes shorter. If this is made longer, the time period from passing-through of the current sheet to the arrival of the next sheet becomes longer during continuous image forming operation, since the leading edge of the image is always at the same position of the photosensitive member 2. This results in slowing down the continuous image formation speed.

Figure 2:
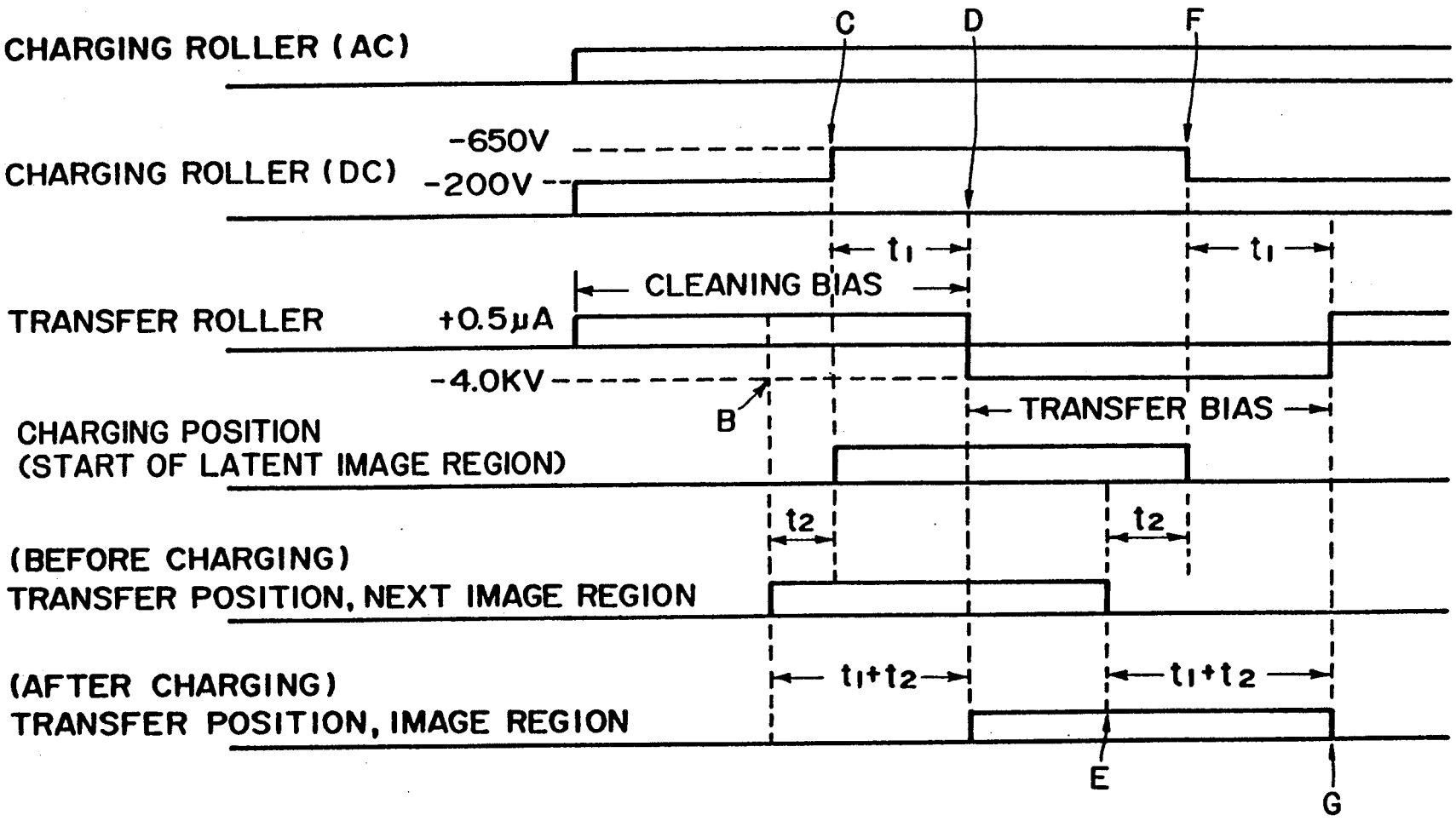
FIG. 2 is a timing chart of sequential operations of the apparatus of FIG. 1.

Therefore, control of the apparatus in accordance with the timing chart of FIG. 2, is desirable. The voltage applied to the charging roller 4 comprises an AC component of 400 Hz and peak-to-peak voltage Vpp of 1500 V in the form of a sine wave and a DC component which is switchable between −650 V and −200 V.

The transfer roller 1 is constant-voltage-controlled at −4.0 KV during the image transfer action and is constant-current-controlled at +0.5 micro-ampere during the cleaning operation.

Figure 3:
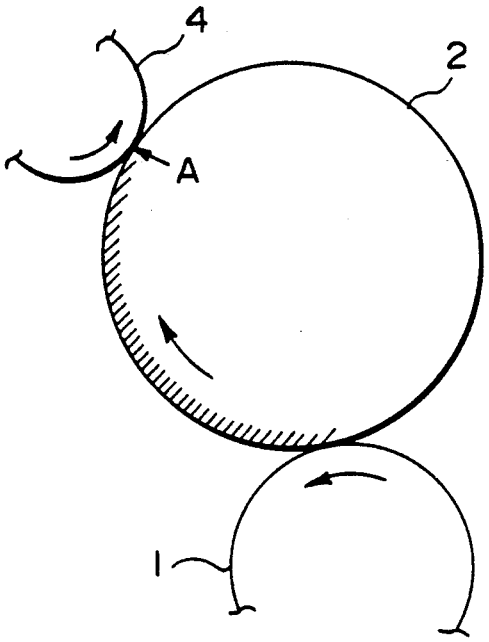
FIGS. 3 and 4 are sectional views illustrating surface potentials of an image bearing member.

FIG. 3 shows a state of one-full turn before the leading edge A of the next image formation area of the photosensitive member 2 is at the charging roller 4. In this state, the hatched portion of the photosensitive member 2 involves a hysteresis in the surface potential. The charging roller 4 is supplied with a voltage comprising a DC component of −200 V. With the rotation of the photosensitive member 2 from the position shown in FIG. 3, the surface potential of the hatched portion becomes −200 V. The −200 V part of the photosensitive member does not receive in the developing position the toner even if the developing bias applied to the developing sleeve is not switched from the image region potential to the non-image region potential. When the hatched portion reaches the transfer position, the hatched portion is subjected to the transfer roller 1 which is supplied with the cleaning bias voltage (such a voltage as to provide +0.5 micro-ampere) from the voltage source 13.

Figure 4:
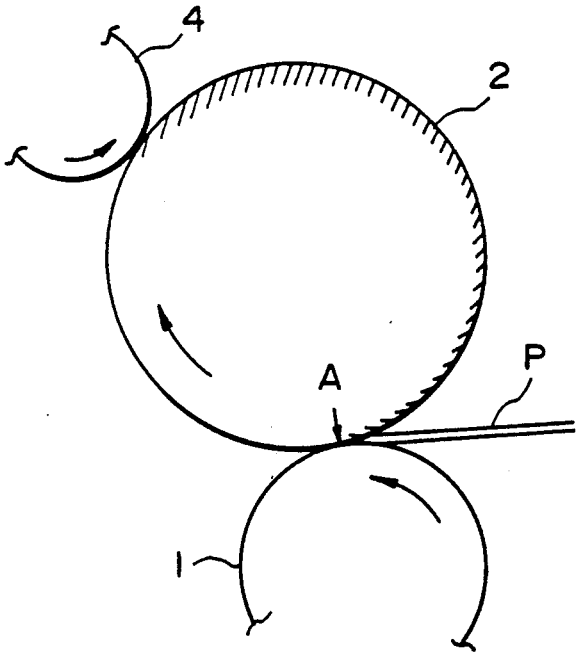

Therefore, the positive toner particles on the transfer roller 1 are transferred to the photosensitive member 2. At this time, the surface of the photosensitive member 2 has a negative potential (−200 V), that is, the charge thereof is opposite from the positive toner, and therefore, the cleaning operation is effectively carried out. By the application of the cleaning bias voltage, the surface potential of the hatched portion after passing through the transfer position becomes uniformly −180 V. When the leading edge portion A arrives again at the charging roller 4, the DC component of the voltage applied to the charging roller 4 is switched to −650 V, so that the next image formation area is uniformly charged to −650 V. Then, the hatched portion is subjected to the image exposure and developing operation. FIG. 4 shows the state wherein the leading edge A of the image formation area reaches the transfer position.

Immediately before the position shown in FIG. 4 is reached, the voltage to the transfer roller is changed to −4.0 KV. Thereafter, the toner image is transferred from the photosensitive member 2 onto the transfer material P. Since the surface potential of the photosensitive member after the image transfer is negative, the potential after the charging by the charging roller 4 thereafter is constant (−650 V) as long as the DC bias supplied to the charging roller 4 is −650 V. Therefore, the uniform potential after the charging can be maintained over the entire image formation area.

FIG. 2 shows a timing chart of the operation described above, wherein $t_1$ is the time required for the photosensitive member 2 rotate from the charging position to the transfer position; $t_2$ is the time required for the photosensitive member 2 rotates from the transfer position to the charging position; and $t_1+t_2$ is the time required for the photosensitive member 2 to rotate through one full-turn. In this embodiment, an image having a length larger than the circumferential length of the photosensitive member 2 can be formed. In such a case, the operation in accordance with the timing chart of FIG. 2 is effective, since it prevents non-uniformity in the image density.

As shown in FIG. 2, in this embodiment, it is possible to apply the cleaning bias to the transfer roller 1 even one-turn rotation before (the point of time B) start of the transfer operation at the leading edge of the image region of the photosensitive member. Therefore, it is not required to switch the bias voltage from the cleaning bias to the transfer bias at the point of time B, as in the foregoing embodiment. Accordingly, in this embodiment as contrasted to the foregoing embodiment, the period of cleaning bias application can be made longer, thus increasing the continuous image forming process speed. According to this embodiment, the region of the photosensitive member which is going to be subjected to the transfer roller 1 supplied with the cleaning bias voltage having the polarity opposite from the charging polarity of the photosensitive member, is charged to the charging polarity of the photosensitive member beforehand, by which the polarity of the potential of the photosensitive member is prevented from becoming opposite from the charging polarity of the photosensitive member, after the transfer roller 1 is cleaned. Therefore, the subsequent primary charging operation can be carried out to provide a uniform potential, so that the image density becomes uniform. In FIG. 2 time $t_1$ is the time required for the point on the surface of the image bearing to move from the charging position to the transfer position and time $t_2$ is the time required for a point on the surface of the image bearing member to move from the transfer position to the charging position. At time B as shown at reference letter B in FIG. 2 and in FIG. 13(A), the position of the photosensitive member at the transfer position will be the image leading position in the next image forming operation. The cleaning bias of $+0.5\ \mu A$ is supplied by the transfer roller. The photosensitive member has been charged by the charging roller to $-200$ V thereafter the potential becomes $-180$ V after passing through the transfer position. At time C as shown in FIG. 2 and in FIG. 13(B) at reference letter C, the leading end of the latent image forming area of the photosensitive member is at the charging position. At this time the charging voltage is switched to $-650$ V. The potential of the position of the photosensitive member after the transfer position is still $-180$ V. At time D, shown in FIG. 2 and FIG. 13(C) at reference letter D, the image leading position and the leading end of the transfer sheet are now at the transfer position. The charger continues to be supplied with $-650$ V. At time E, shown in FIG. 2 and in FIG. 13(D) at reference letter E, the image transfer operation continues at the transfer position. At the charger position the charging for image formation continues. The portion of the photosensitive member which is going to be the trailing end of the image after one full turn of the photosensitive member is positioned at the transfer position. At time F, indicated by reference letter F in FIG. 2 and in FIG. 13(E), the transfer operation continues at the transfer position. The trailing end of the latent image is at the charging position and the charging voltage is switched to $-200$ V. At time G, indicated by reference G in FIGS. 2 and in 13(F) image transfer is finished. The transfer roller voltage is then switched to a cleaning bias of $+0.5\ \mu A$. In all of these diagrams shown in FIGS. 13(A)-(F) the position of the drum surface which is going to be the leading end of the next image is designated by reference letter A.

Figure 5:
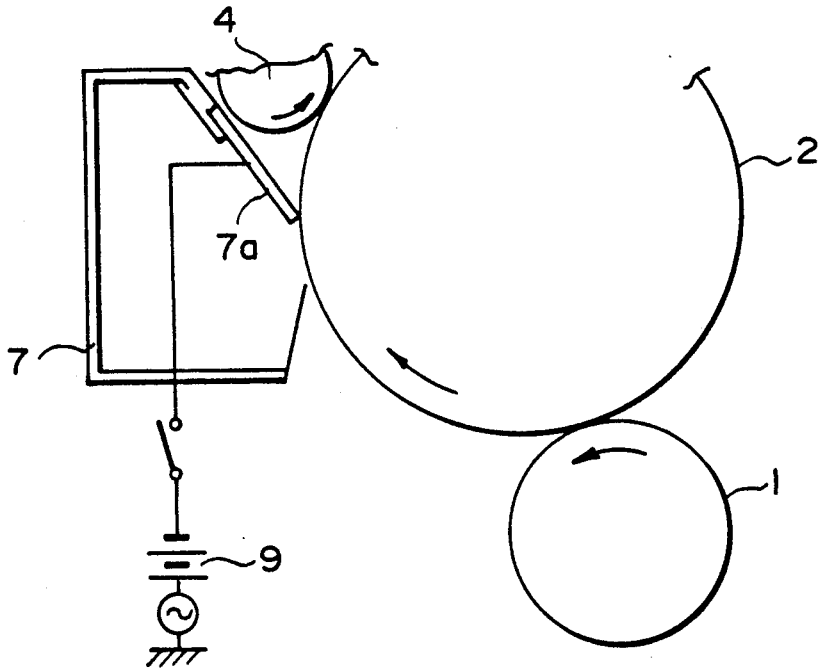
FIGS. 5, 6, 7 and 8 are sectional views illustrating the major parts of the image forming apparatuses according to other embodiments of the present invention.

FIG. 5 illustrates another embodiment, wherein a cleaning blade *7a* of the cleaner 7 is of urethane rubber in which carbon is dispersed to provide a volume resistivity of $10^8$ ohm.cm. As shown, the cleaning blade *7a* is supplied with an AC voltage having a frequency of 400 Hz and a peak-to-peak voltage Vpp of 1300 V and also a DC voltage of $-200$ V, by the voltage source 9.

The structure and the operational timing of the photosensitive member 2 and the transfer roller 1 are the same as in the foregoing embodiment. However, the DC component to the charging roller 4 is fixed at $-650$ V. The voltage to the cleaning blade is supplied until the region of the photosensitive member 2 subjected to the transfer roller 1 supplied with the cleaning bias voltage has passed by the cleaning blade *7a*. Therefore, even if the photosensitive member 2 is charged to a positive polarity by the application of the cleaning bias voltage to the transfer roller 1, the region is negatively charged by the cleaning blade *7a*, and therefore, the subsequent image forming operation does not result in a density non-uniformity.

Figure 6:
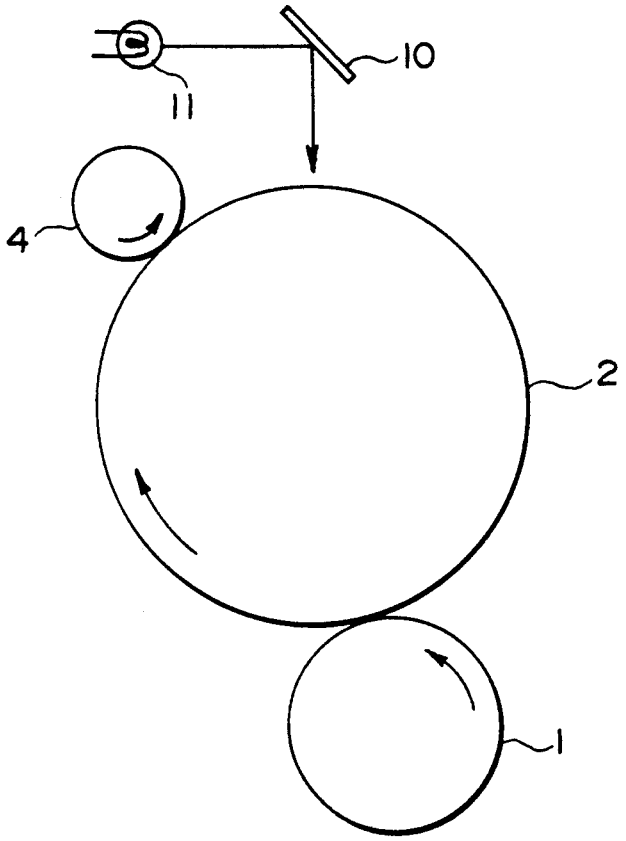

FIG. 6 illustrates a further embodiment wherein the structures and the operational timing of the photosensitive member 2, the transfer roller 1 and the charging roller 4 are the same as in the foregoing embodiment. A blank shutter 10 receives light from a lamp 11 and reflects it to the surface of the photosensitive member 2. The DC component of the voltage applied to the charging roller 4 is fixed at $-650$ V. The region of the photosensitive member 2 to which the cleaning bias is applied from the transfer roller 1 receives the light from the lamp 11 so that the potential becomes $-200$ V after the blank exposure. Thus, the region of the photosensitive member subjected to the transfer roller 1 supplied with the cleaning bias voltage is charged to a negative polarity, and therefore, the non-uniformity of the image density does not result in the subsequent image forming operation.

The structures of FIGS. 5 and 6 are advantageous from the standpoint of cost, because the necessity is eliminated for switching of the charging bias voltage.

Figure 7:
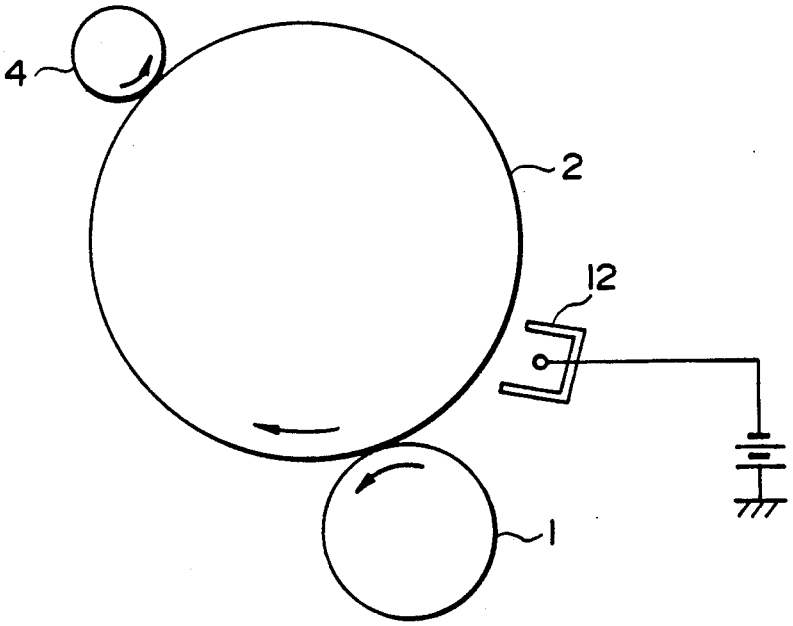

FIG. 7 illustrates a yet further embodiment wherein a pre-charger 12 is used between the developing position and the transfer position. In place of charging the photosensitive member 2 to $-200$ V by the charging roller 4 as in the foregoing embodiment, the region of the photosensitive member 2 subjected to the transfer roller 1 supplied with the cleaning bias voltage is charged beforehand to $-200$ V.

This structure also eliminates the necessity for the switching of the DC component of the charging voltage.

Figure 8:
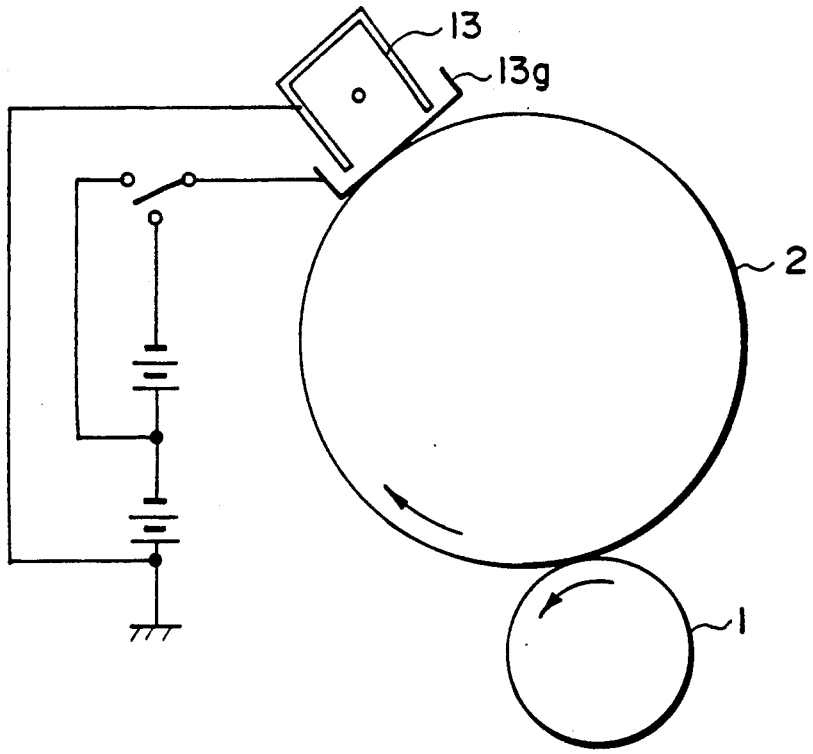

FIG. 8 illustrates a further embodiment, wherein the structure and the operational timing of the photosensitive member 2 and the transfer roller 1 are the same as in the foregoing embodiments.

The charging means is a scorotron charger 13 rather than the charging roller 4, and the bias voltage supplied to the grid 13*g* is switched between two positions to control the charging potential.

The region of the photosensitive member which is going to be subjected to the transfer roller 1 supplied with the transfer bias voltage is subjected to the charging operation with the grid voltage of $-700$ V so that the region is charged to $-650$ V. The region of the photosensitive member which is going to be subjected to the transfer roller 1 supplied with the cleaning bias is charged with the grid voltage of $-250$ V, so that it is charged to $-200$ V. By doing so, a positive polarity memory is not produced in the photosensitive member 2 by the cleaning bias, and therefore, the non-uniformity of the image does not result in the subsequent image forming operation.

In the foregoing embodiments, the transfer roller 1 is press-contacted to the photosensitive member 2. However, it is possible to provide a clearance therebetween which is smaller than the thickness of the transfer material.

In the foregoing embodiments, what is cleaned is the transfer roller. However, the present invention is applicable to any member contactable to the image bearing member, such as a cleaning roller or the like. In other words, the contactable member is supplied with a bias voltage having a polarity the same as that of the toner during the developing operation, by which the toner on the contactable member is returned to the image bearing member.

As described in the foregoing, according to the present invention, the transfer member or another member contactable to the image bearing member can be effectively cleaned, so that the contamination of the backside of the transfer material and/or the scattering of the toner can be prevented.

In addition, no memory is produced in the image bearing member, and therefore, good images without a density non-uniformity can be provided.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

an image bearing member movable along an endless path;

image forming means for forming a toner image on said image bearing member, said image forming means including charging means for charging said image bearing member and developing means for developing an image on said image bearing member;

transfer means for transferring the toner image from said image bearing member to a transfer material at a transfer position, said transfer means including a transfer member contactable to a backside of the transfer material, said transfer member being supplied with a voltage having a polarity which is the same as a charging polarity of the toner during a developing operation to transfer the toner from said transfer member to said image bearing member, when the transfer material is absent at the transfer position; and means for causing a region of said image bearing member to have a potential of the same polarity as the charging polarity of said charging means, before the region is charged by said charging means for image formation, wherein said image forming means subsequently forms a toner image on said region after being charged by said charging means.

2. An apparatus according to claim 1, wherein the charging polarity of said charging means is opposite from a polarity of charge of the toner during a developing operation.

3. An apparatus according to claim 1 or 2, wherein said region includes a region which has been at the transfer position when said transfer member is supplied with the voltage having the same polarity as the charging polarity of the toner.

4. An apparatus according to claim 1 or 2, wherein said region includes a region which has been at the transfer position when said transfer member is supplied with a voltage of the same polarity as the charging polarity of the toner during a developing operation and a region which has been at the transfer position during a transfer operation.

5. An apparatus according to claim 1 or 2, wherein said transfer member is contactable to said image bearing member.

6. An apparatus according to claim 1 or 2, wherein said image bearing member is rotatable, and wherein said apparatus is capable of forming an image having a length which is larger than a circumferential length of said image bearing member.

7. An apparatus according to claim 1 or 2, wherein said image bearing member is a photosensitive member.

8. An apparatus according to claim 7, wherein said image bearing member is composed of an organic photoconductor.

9. An apparatus according to claim 1, wherein said region, which has been at the transfer position when said transfer member is supplied with the voltage having the same polarity as the charging polarity of the toner, has been given the potential by said causing means, when said region comes to the transfer position.

10. An apparatus according to claim 9, wherein the region which has been at the transfer position when said transfer member is supplied with the voltage having the same polarity as the charging polarity of the toner, acquires the same polarity as the charging polarity of said charging means after passing through the transfer position.

11. An apparatus according to claim 1 or 2, wherein said providing causing means charges to the same polarity as the charging polarity of said charging means a region of said image bearing member which has been at the transfer position when said transfer member is supplied with the voltage having the same polarity as the charging polarity of the toner during the developing operation.

12. An apparatus according to claim 11, wherein said causing means includes charging means.

13. An apparatus according to claim 12, wherein said charging means of said causing means is contactable to said image bearing member.

14. An image forming apparatus, comprising:

an image bearing member movable along an endless path;

image forming means for forming a toner image on said image bearing member, said image forming means including charging means for charging said image bearing member and developing means for developing an image on said image bearing member with toner;

transfer means for transferring the toner image from said image bearing member onto a transfer material at a transfer position, and transfer means having a transfer member contactable to a backside of the transfer material, the transfer member being supplied with a voltage of the same polarity as the toner during a developing operation to transfer the toner from said transfer member to said image bearing member, when the transfer material is absent at the transfer position;

means for causing a region of said image bearing member to have a potential of the polarity which is the same as the charging polarity of said charging means before said region reaches the transfer position, so that said region does not have a polarity opposite from the charging polarity of said charging means after said region passes through the transfer position, wherein said transfer member is supplied with the voltage when said region is at the transfer position.

15. An apparatus according to claim 14, wherein said charging means also functions as said causing means.

16. An apparatus according to claim 14, wherein said transfer member is supplied with a voltage having the same polarity as the toner during the developing operation, when the transfer material is absent at the transfer position, before a transfer operation.

17. An apparatus according to claim 14, wherein said transfer member is contactable to said image bearing member.

18. An apparatus according to claim 14, wherein said image bearing member is a photosensitive member.

19. An apparatus according to claim 18, wherein said image bearing member includes an organic photoconductive layer.

20. An image forming apparatus, comprising:

an image bearing member movable along an endless path;

image forming means for forming a toner image on said image bearing member, said image forming means including charging means for charging said image bearing member;

a member contactable to said image bearing member, said contactable member being supplied with a voltage having the same polarity as the toner during a developing operation to transfer the toner from said contactable member to said image bearing member; and means for causing a region of said image bearing member to have a potential of a polarity which is the same as the charging polarity of said charging means before said region reaches a position at which said region contacts said contactable member so that said region does not have a polarity opposite from the charging polarity of said charging means after said region passes through said position.

21. An apparatus according to claim 20, wherein said charging means also functions as said causing means.

22. An apparatus according to claim 12, 15, or 21, wherein when said region is supplied with the potential, said charging means is supplied with a voltage lower than that supplied thereto for charging said image bearing member for image formation.

23. An apparatus according to claim 20, wherein said image bearing member is a photosensitive member.

24. An apparatus according to claim 23, wherein said image bearing member has an organic photoconductor photosensitive layer.

25. An image forming apparatus, comprising:

an image bearing member movable along an endless path;

image forming means for forming a toner image on said image bearing member, said image forming means including charging means for charging said image bearing member and developing means for developing an image on said image bearing member;

transfer means for transferring the toner image from said image bearing member to a transfer material at a transfer position, said transfer means including a transfer member contactable to a backside of the transfer material, said transfer member being supplied with a voltage having a polarity which is opposite from charging polarity of said charging means to transfer the toner from said transfer member to said image bearing member when the transfer material is absent at the transfer position; and means for causing a region of said image bearing member to have a potential of the same polarity as the charging polarity of said charging means before said region is charged by said charging means for image formation, wherein said charging means charges said region and said image forming means forms an image on said region after said region has a potential of the same polarity as the charging polarity of said charging means.

26. An apparatus according to claim 25, wherein the charging polarity of said charging means is opposite from the polarity of charge of the toner during a developing operation.

27. An apparatus according to claim 25 or 26, wherein said region includes a region which has been at the transfer position when said transfer member is supplied with the voltage having a polarity which is opposite from a charging polarity of said charging means.

28. An apparatus according to claim 25 or 26, wherein said region includes a region which has been at the transfer position when said transfer member is supplied with a voltage of a polarity which is opposite from a charging polarity of said charging means and a region which has been at the transfer position during a transfer operation.

29. An apparatus according to claim 25 or 26, wherein said transfer member is contactable to said image bearing member.

30. An apparatus according to claim 25 or 26, wherein said image bearing member is rotatable, and wherein said apparatus is capable of forming an image having a length which is larger than a circumferential length of said image bearing member.

31. An apparatus according to claim 25 or 26, wherein said image bearing member is a photosensitive member.

32. An apparatus according to claim 31, wherein said image bearing member is composed of an organic photoconductor.

33. An apparatus according to claim 25, wherein the region which has been at the transfer position when said transfer member is supplied with the voltage having the polarity which is opposite from the charging polarity of said charging means, is given the potential by said causing means, when said region comes to the transfer position.

34. An apparatus according to claim 33, wherein the region which has been at the transfer position when said transfer member is supplied with the voltage having a polarity which is opposite from the charging polarity of said charging means acquires the same polarity as the charging polarity of said charging means after said region passes through the transfer position.

35. An apparatus according to claim 25 or 26, wherein said causing means charges to the same polarity as the charging polarity of said charging means a region of said image bearing member which has been at the transfer position when said transfer member is supplied with the voltage having a polarity which is opposite from a charging polarity of said charging means.

36. An apparatus according to claim 35, wherein said causing means includes charging means.

37. An apparatus according to claim 36, wherein said charging means is contactable to said image bearing member.

38. An image forming apparatus, comprising:

an image bearing member movable along an endless path;

image forming means for forming a toner image on said image bearing member, said image forming means including charging means for charging said image bearing member and developing means for developing an image on said image bearing member with toner;

transfer means for transferring the toner image from said image bearing ember onto a transfer material at a transfer position, said transfer means having a transfer member contactable to a backside of the transfer material, said transfer member being supplied with a voltage of a polarity which is opposite from a charging polarity of said charging means to transfer the toner from said transfer member to said image bearing member, when the transfer material is absent at the transfer position; and means for causing a region of said image bearing member to have a potential of a polarity which is the same as the charging polarity of said charging means before said region reaches the transfer position, so that said region does not have a polarity opposite from the charging polarity of said charging means after said region passes through the transfer position, wherein said region is at the transfer position when said voltage is supplied to said transfer member.

39. An apparatus according to claim 38, wherein said charging means also functions as said causing means.

40. An apparatus according to claim 38, wherein said transfer member is supplied with a voltage having the same polarity as the toner during the developing operation when the transfer material is absent at the transfer position, before a transfer operation.

41. An apparatus according to claim 38, wherein said transfer member is contactable to said image bearing member.

42. An apparatus according to claim 38, wherein said image bearing member is a photosensitive member.

43. An apparatus according to claim 42, wherein said image bearing member includes an organic photoconductive layer.

44. An image forming apparatus, comprising:

an image bearing member movable along an endless path;

image forming means for forming a toner image on said image bearing member, said image forming means including charging means for charging said image bearing member;

a member contactable to said image bearing member, said contactable member being supplied with a voltage having a polarity which is opposite from the charging polarity of said charging means to transfer the toner from said contactable member to said image bearing member; and means for causing a region of said image bearing member which a potential of a polarity which is the same as the charging polarity of said charging means before said region reaches a position of contact with said contactable member, so that said region does not have a polarity opposite from the charging polarity of said charging means after said region passes through said position.

45. An apparatus according to claim 44, wherein said charging means also functions as said causing means.

46. An apparatus according to claim 36, 39 or 45, wherein when said region is supplied with the potential, said charging means is supplied with a voltage lower than that supplied thereto for charging said image bearing member for image formation.

47. An apparatus according to claim 44, wherein said image bearing member is a photosensitive member.

48. An apparatus according to claim 47, wherein said image bearing member has an organic photoconductor photosensitive layer.

* * * * *

UNITED STATES PATENT AND TRADEMARK OFFICE

CERTIFICATE OF CORRECTION

PATENT NO. : 5,182,604

DATED : January 26, 1993

INVENTOR(S) : JUN ASAI

It is certified that error appears in the above-identified patent and that said Letters Patent is hereby corrected as shown below:

COLUMN 1

Line 47, "to" should be deleted.

COLUMN 3

Line 56, "to" should be deleted;
Line 63, "time" should read --the time--.

COLUMN 4

Line 46, "resistivities." should read --volume resistivities.--.

COLUMN 6

Line 54, "rotate" should read --to rotate--;
Line 56, "rotates" should read --to rotate--.

COLUMN 7

Line 22, "bearing" should read --bearing member--;
Line 56, "FIGS. 2" should read --FIG. 2-- and "13(F)" should read --FIG. 13(F)--.

COLUMN 8

Line 34, "of" should be deleted.

UNITED STATES PATENT AND TRADEMARK OFFICE

CERTIFICATE OF CORRECTION

PATENT NO. : 5,182,604

DATED : January 26, 1993

INVENTOR(S) : JUN ASAI

It is certified that error appears in the above-identified patent and that said Letters Patent is hereby corrected as shown below:

IN THE CLAIMS

COLUMN 10

Line 31, "providing" should be deleted;
Line 54, "and" should read --said--.

COLUMN 13

Line 11, "ember" should read --member--.

COLUMN 14

Line 20, "which a" should read --having a--.

Signed and Sealed this

Twenty-second Day of March, 1994

*Attest:*

Bruce Lehman

BRUCE LEHMAN

*Attesting Officer*

*Commissioner of Patents and Trademarks*